US006026997A

United States Patent [19]

Kremer et al.

[11] Patent Number: 6,026,997

[45] Date of Patent: Feb. 22, 2000

[54] STOPPER ROD

[75] Inventors: Alfred Kremer, Borken; Gerhard Langer, Bochum, both of Germany

[73] Assignee: Foseco International Limited, Wiltshire, United Kingdom

[21] Appl. No.: 09/202,710

[22] PCT Filed: Jun. 24, 1997

[86] PCT No.: PCT/GB97/01718

§ 371 Date: Mar. 17, 1999

§ 102(e) Date: Mar. 17, 1999

[87] PCT Pub. No.: WO98/00255

PCT Pub. Date: Jan. 8, 1998

[30] Foreign Application Priority Data

Jul. 2, 1996 [GB] United Kingdom ..... 9613810

[51] Int. Cl.[7] ..... B22D 41/08

[52] U.S. Cl. ..... 222/602; 266/271

[58] Field of Search ..... 222/602, 591; 266/271, 272

[56] References Cited

U.S. PATENT DOCUMENTS

| | | | |
|---|---|---|---|
| 5,303,905 | 4/1994 | Pohl et al. | 266/271 |
| 5,681,497 | 10/1997 | Labod | 222/602 |
| 5,695,675 | 12/1997 | Labod | 222/602 |
| 5,851,414 | 12/1998 | Ando et al. | 266/271 |

FOREIGN PATENT DOCUMENTS

| | | |
|---|---|---|
| 0 544 997 | 6/1993 | European Pat. Off. . |
| 40 40 189 | 1/1992 | Germany . |
| 40 28 793 | 3/1992 | Germany . |
| 40 32 454 | 4/1992 | Germany . |
| WO 95/03145 | 2/1995 | WIPO . |

*Primary Examiner*—Scott Kastler
*Attorney, Agent, or Firm*—Nixon & Vanderhye P.C.

[57] ABSTRACT

A stopper rod in the form of an elongate molded body having a longitudinal bore has an attachment device for attaching the stopper rod to a lifting and lowering mechanism. The attachment device comprises a first sleeve to be molded in-situ in the stopper rod body to lie coaxially with the stopper rod body in an annular recess surrounding and coterminous with the bore, the sleeve having a pair of circumferentially-spaced inwardly-directed, arcuate flanges, a connecting rod of diameter to fit into the stopper rod bore and of length to extend outside the stopper rod while passing through the first sleeve when the sleeve is in position in the stopper rod, the connecting rod having a pair of circumferentially-spaced, arcuate shoulders of size to pass through the spaces between the flanges of the first sleeve, so that the connecting rod may be passed through the first sleeve until its shoulders have passed beyond the flanges of the first sleeve and then rotated until its shoulders are in circumferential correspondence with the flanges, and a second sleeve of external diameter to fit in the bore of the stopper rod and having at one end a pair of circumferentially-spaced, arcuate, axially-extending projections, the projections having an internal radius sufficient to accommodate the connecting rod through the second sleeve and the projections being of a size to fit into the spaces between the flanges of the first sleeve so that the shoulders of the connecting rod may be locked beyond the flanges of the first sleeve.

16 Claims, 5 Drawing Sheets

FIG.1.
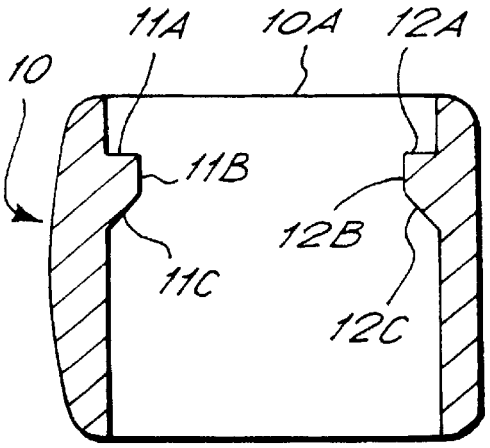
FIG.3.
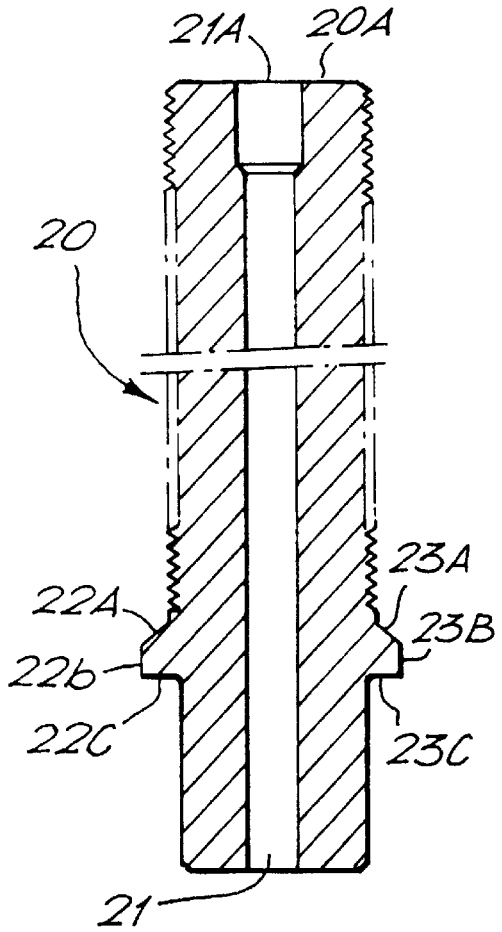
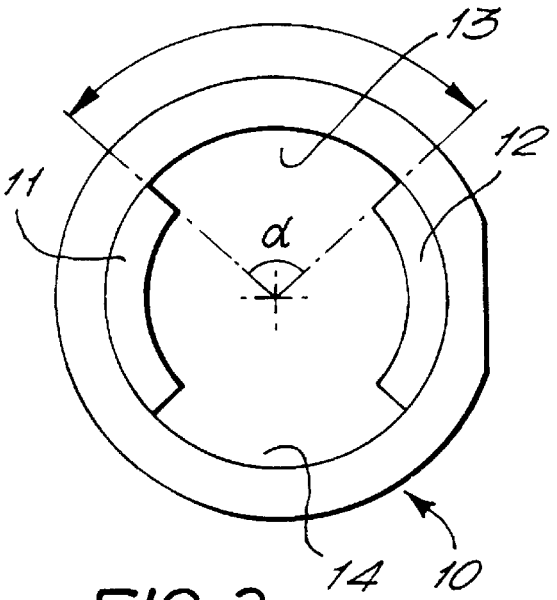
FIG. 2.
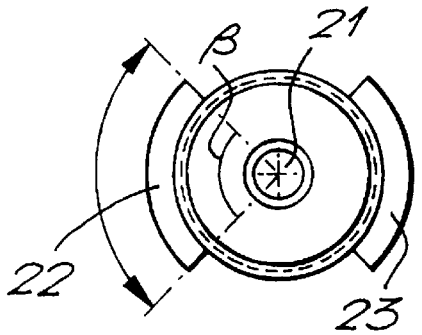
FIG. 4.

FIG. 8.
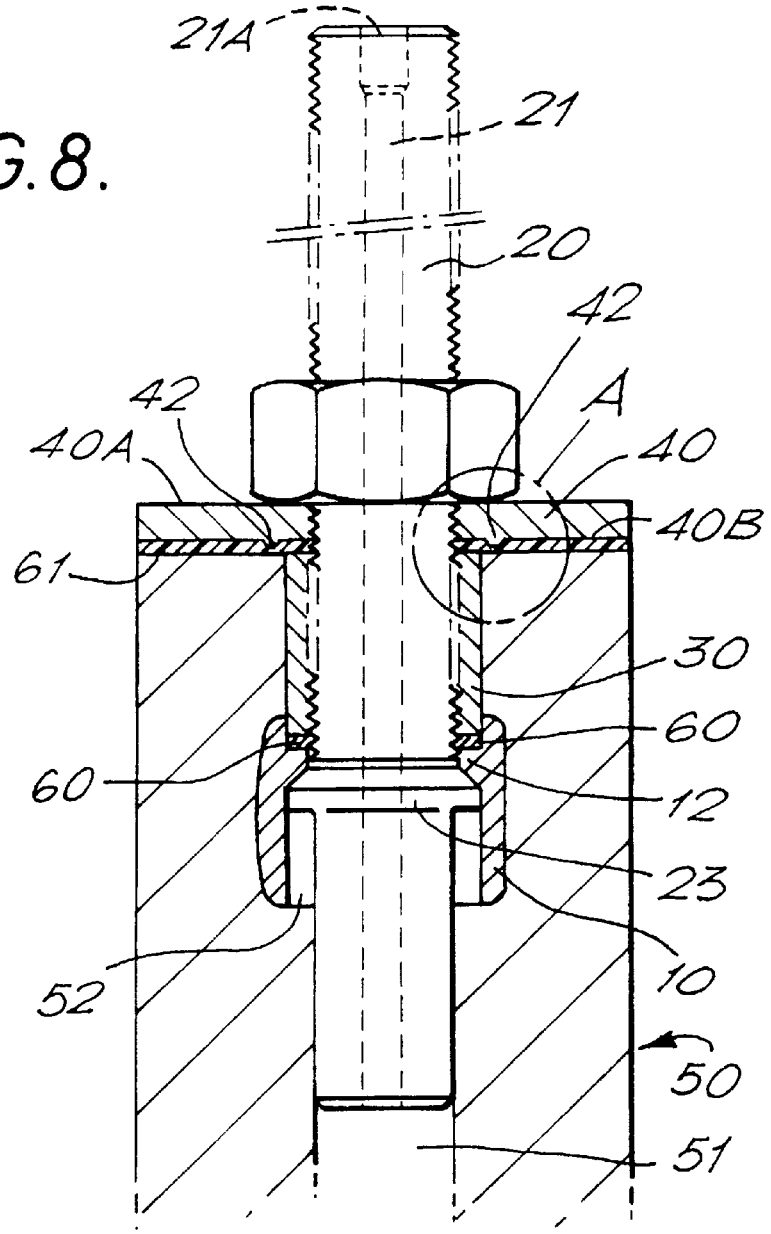
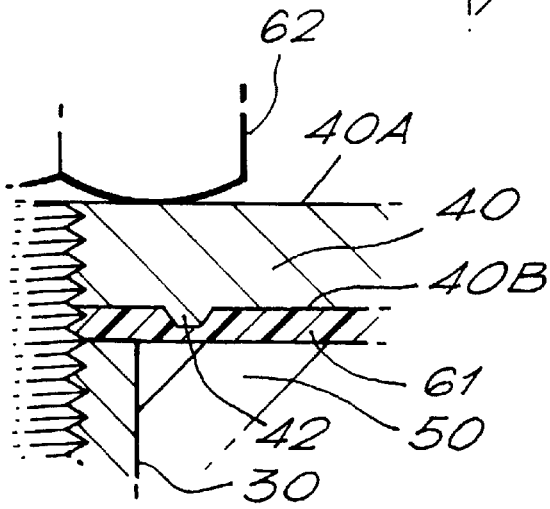
FIG. 8A.

STOPPER ROD

CROSS-REFERENCE TO RELATED APPLICATION

This is a U.S. national phase of PCT/GB97/01718 having an international filing date of Jun. 24, 1997.

BACKGROUND AND SUMMARY OF THE INVENTION

This invention relates to a stopper rod and particularly to a means of attaching a stopper rod to a lifting and lowering mechanism.

Stopper rods are well known for use in controlling molten metal flow from a vessel, e.g. a tundish, into a mould. A stopper rod is raised and lowered by a suitable mechanism positioned adjacent the vessel and can thereby be used to close fully or partially or open fully the outlet from the vessel, thus controlling flow of the metal from the vessel.

Conventionally, a stopper rod is formed as an elongate one-piece bonded graphite structure by isostatic pressing in a suitable mould. The stopper rod usually has a hollow structure in that it is formed to have a longitudinal, centrally-disposed bore by use of a suitable removable core in the mould. The lower end of the stopper rod bore may be closed or it may be vented to allow gas, e.g. argon, to be passed through the rod.

Thus, in the conventional manufacture of a stopper rod, the desired graphite composition is placed around a removable core in a deformable mould, i.e. the graphite composition fills the mould space between the core and the deformable mould. The deformable mould is then placed in a tank of liquid, for example water, and the pressure of the liquid is increased by known means to the pressure required to convert the graphite composition to the desired self-supporting structure. After removal of the isostatically pressed product from the mould, the core is removed to provide the hollow stopper rod.

The upper end of the rod must be provided with means by which it can be attached to the lifting and lowering mechanism. Various prior proposals have been made, including co-pressing a threaded bush in the upper end of the stopper rod to receive a threaded shaft; forming the upper end of the bore of the rod with an internal thread to receive an insert, e.g. of ceramic material, and placing a retaining pin through coterminous holes drilled through the stopper rod and an attachment rod.

While each prior proposal has certain merits, none is entirely successful and it is, therefore, an object of the present invention to provide an improved means of attaching a stopper rod to a lifting and lowering mechanism.

Accordingly, in one aspect the present invention provides a means of attaching a stopper rod in the form of an elongate moulded body having a longitudinal bore to a lifting and lowering mechanism, the means comprising a first sleeve to be moulded in-situ in the stopper rod body to lie coaxially with the stopper rod body in an annular recess surrounding and coterminous with the bore, the sleeve having a pair of circumferentially-spaced inwardly-directed, arcuate flanges, a connecting rod of diameter to fit into the stopper rod bore and of length to extend outside the stopper rod while passing through the first sleeve when the sleeve is in position in the stopper rod, the connecting rod having a pair of circumferentially-spaced, arcuate shoulders of size to pass through the spaces between the flanges of the first sleeve, whereby the connecting rod may be passed through the first sleeve until its shoulders have passed beyond the flanges of the first sleeve and then rotated until its shoulders are in circumferential correspondence with the flanges, and a second sleeve of external diameter to fit in the bore of the stopper rod and having at one end a pair of circumferentially-spaced, arcuate, axially-extending projections, the projections having an internal radius sufficient to accommodate the connecting rod through the second sleeve and the projections being of a size to fit into the spaces between the flanges of the first sleeve whereby the shoulders of the connecting rod may be locked beyond the flanges of the first sleeve.

In a second aspect, the invention provides a stopper rod fitted with the means of attachment to a lifting and lowering mechanism as defined in the immediately preceding paragraph.

The connecting rod is preferably externally-threaded, at least for a portion of its length intended to extend from the stopper rod, whereby it may be threadably connected to a corresponding portion of the lifting and lowering mechanism. (The lifting and lowering mechanism itself may otherwise be as conventionally used.) Alternative connecting means between the connecting rod and the lifting and lowering mechanism may, however, be utilised, if desired.

The bore of the stopper rod may extend for the entire length of the stopper rod or, if desired, the lower end of the stopper rod bore may be closed. In those embodiments where the lower end of the stopper rod is vented, i.e. the bore, albeit of possibly reduced diameter, extends throughout, so that gas, e.g. argon, may be passed through the stopper rod, the connecting rod should also have an axially-extending bore for that purpose.

The first sleeve, which may be of any suitable material, e.g. metal or ceramic material, is conveniently moulded into the desired position in the stopper rod body during the moulding of that body. Thus, for example, during the otherwise conventional isostatic pressing of the stopper rod in a mould containing a removable core to define the bore, the first sleeve is positioned in the desired position in the mould.

The first sleeve may be of circular outline in plan view but this is not essential. For example, it may be provided with one or more 'flats', i.e. flat-sided portions around its periphery in order to achieve better locking into position when it is moulded in-situ into the stopper rod body.

The second sleeve may also be of any suitable material, e.g. metal or ceramic material.

Preferably, the second sleeve is of such a height as to have its end remote from its projections lying in, or very close to, the plane of the upper end of the stopper rod when the attachment means is fitted. It is preferably of outside diameter such that it is a tight fit in the bore at the upper end of the stopper rod.

In a preferred embodiment, an apertured pressure disc is carried on the connecting rod and is maintained under pressure against the upper face of the stopper rod. It can thereby maintain pressure against the end of the second sleeve and thus ensure that, in use of the stopper rod, the second sleeve cannot move up the connecting rod and thereby loosen the locked nature of the attachment means. The pressure may be maintained by a nut threaded onto the connecting rod and rotated along the rod until it bears sufficiently on the disc.

If desired, of course, alternative means may be used to provide axially inward pressure on the end of the second sleeve to ensure that it remains in the locked position.

Sealing means may be provided as required. For example, a sealing washer may be positioned between the pressure disc and the upper face of the stopper rod and between the upper faces of the flanges of the first sleeve and the corresponding face of the second sleeve.

BRIEF DESCRIPTION OF THE DRAWINGS

FIG. 1 is a longitudinal section through a first sleeve;

FIG. 2 is a plan view of the sleeve of FIG. 1;

FIG. 3 is a longitudinal section through a connecting rod;

FIG. 4 is a plan view of the rod of FIG. 3;

FIG. 8 is a part-sectional view showing the assembled attachment means at the upper end of a stopper rod;

FIG. 8A is an enlarged view of area A of FIG. 8;

DETAILED DESCRIPTION OF THE DRAWINGS

Figure 5:
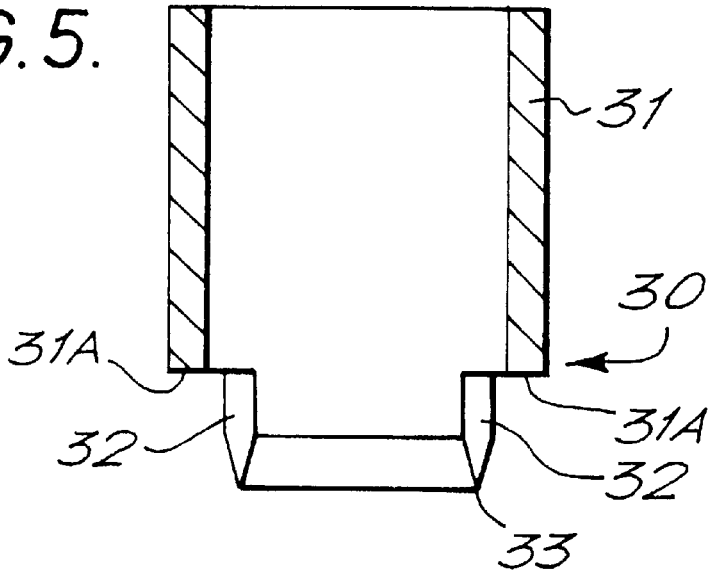
FIG. 5 is a longitudinal section through a second sleeve.

In FIGS. 1 and 2 is shown a first sleeve 10 having a pair of circumferentially-spaced, inwardly directed arcuate flanges, 11, 12, each positioned a short, equal distance axially from one end 10A of the sleeve. End 10A of the sleeve will be uppermost when moulded into a stopper rod, i.e. it will be nearest to the upper working surface of the stopper rod in use. Each flange has a flat upper surface, 11A, 12A respectively, an axially-extending inner face 11B, 12B respectively and a sloping lower face, 11C, 12C respectively. As shown, the outer perimeter of the sleeve is not a complete circle but has a flat side to increase the locking effect when the sleeve is moulded into a stopper rod body.

Circumferentially between flanges 11 and 12 lie an opposed pair of frusto-annular spaces 13 and 14. The circumferential arc of each of spaces 13 and 14 may extend for an angle a, defined by the arrows in FIG. 2, that is a little greater than 90°, e.g. 96°. Thus, the arcuate extent of spaces 13 and 14 is a little greater than the arcuate extent of flanges 11 and 12.

In FIGS. 3 and 4 is shown a connecting rod 20 having a longitudinally-extending through bore 21. At one end 20A of the connecting rod, which will be its upper end in use, the bore 21 is stepped to provide a wider mouth portion 21A to receive a connector to a gas line, usually argon.

The exterior surface of connecting rod 20 is provided towards its lower end with an opposed pair of circumferentially-spaced, arcuate shoulders 22, 23. Each shoulder has a sloping upper surface 22A, 23A respectively, an axially-extending outer face 22B, 23B respectively and a flat lower surface 22C, 23C respectively. The arcuate extent of shoulders 22, 23, i.e. angle b defined by the arrows in FIG. 4, is smaller than that of annular spaces 13 and 14 of the first sleeve. Thus, shoulders 22 and 23 can pass through spaces 13 and 14 when rod 20 is passed through sleeve 10.

Figure 6:
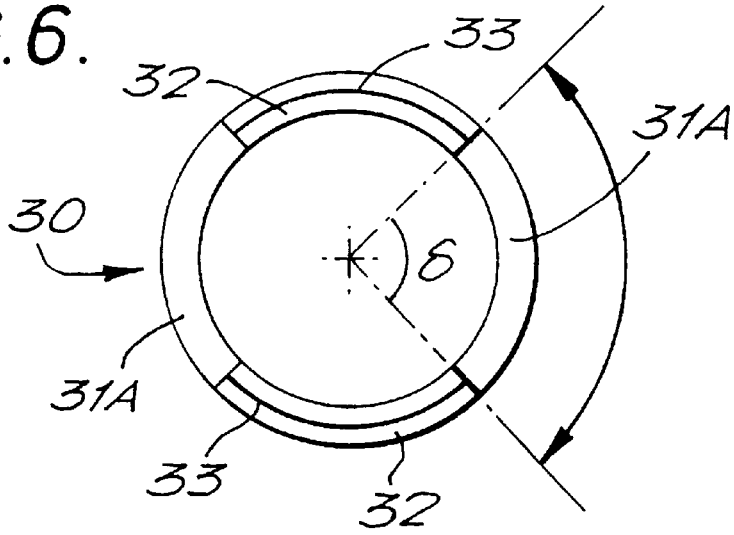
FIG. 6 is a plan view of the sleeve of FIG. 5.

In FIGS. 5 and 6 is shown a second sleeve 30. This has a cylindrical body 31 at one end 31A of which is provided a pair of circumferentially-spaced, arcuate, axially-extending projections 32. The projection 32 are of equal arcuate length and are each tapered at their ends to a point 33. The external arc of each of projections 32 is of a diameter less than that of the internal diameter of cylindrical body 31.

Each of projections 32 extends for an arc of approximately 90° so that the arc between the adjacent ends of the two projections, angle d defined by the arrows in FIG. 6, is also approximately 90°. Thus, arcuate projections 32 are of a size sufficiently small to fit into spaces 13 and 14 of first sleeve 10.

Figure 7:
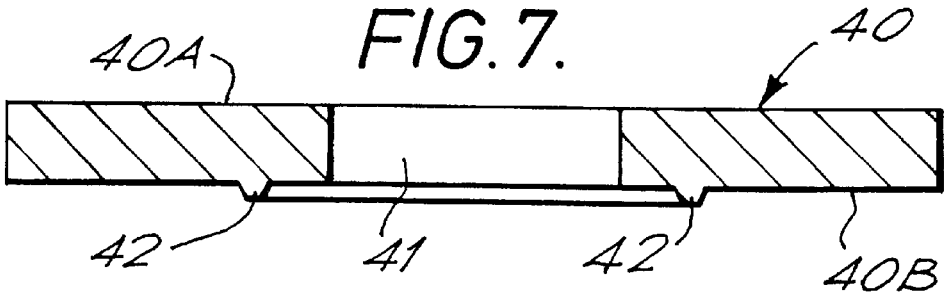
FIG. 7 is a section through a pressure disc.

FIG. 7 shows a pressure disc 40 having main faces 40A and 40B and a central bore 41. Projecting from one face 40B is a small protuberance 42, in the form of an annular rib surrounding and spaced from bore 41.

Figure 9:
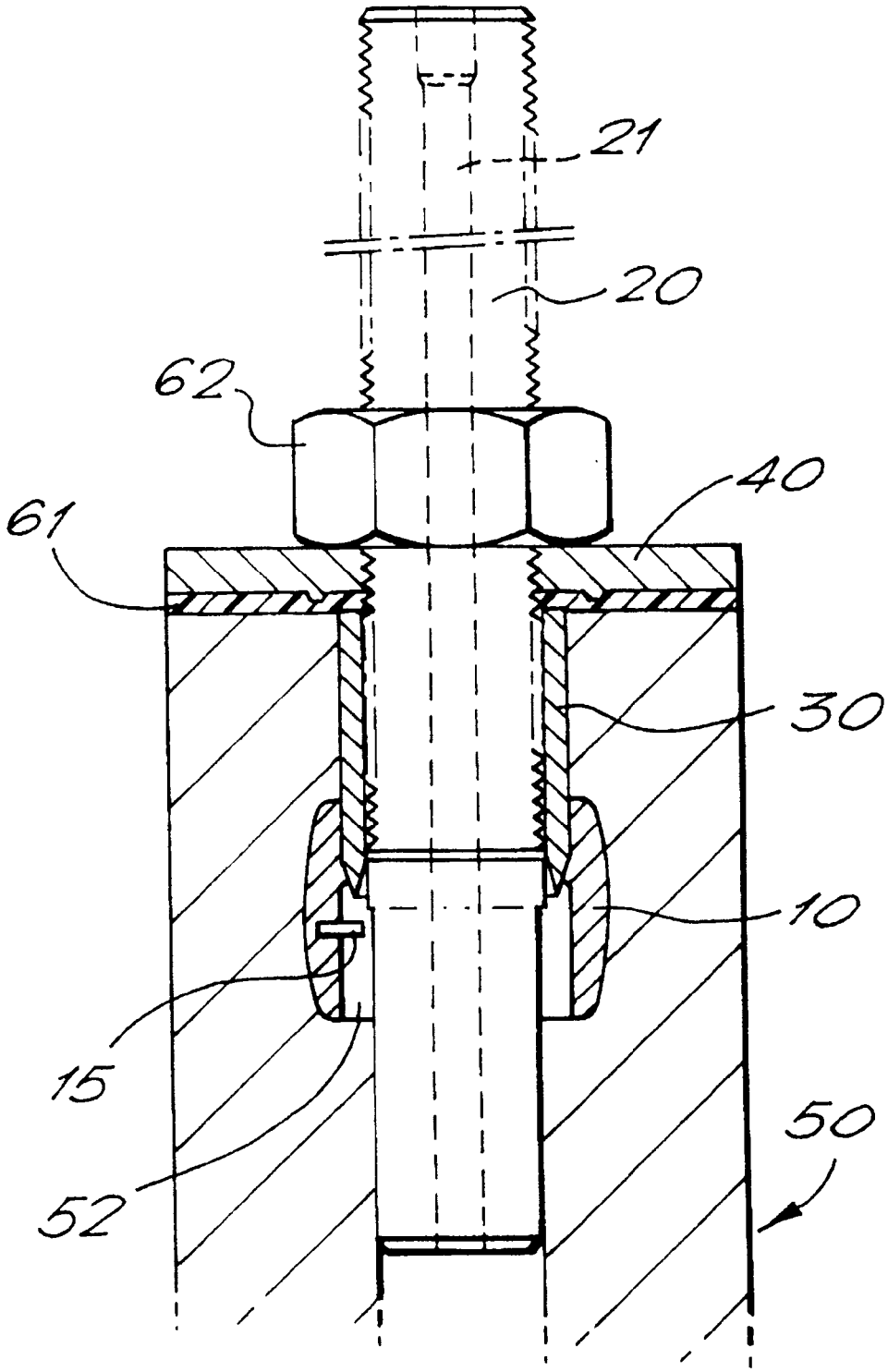
FIG. 9 is a similar view to FIG. 8 but with the assembly rotated through 90° about its longitudinal axis and FIGS. 10, 11 and 12 are similar sections to FIG. 7 through alternative forms of pressure disc.
Figure 10:
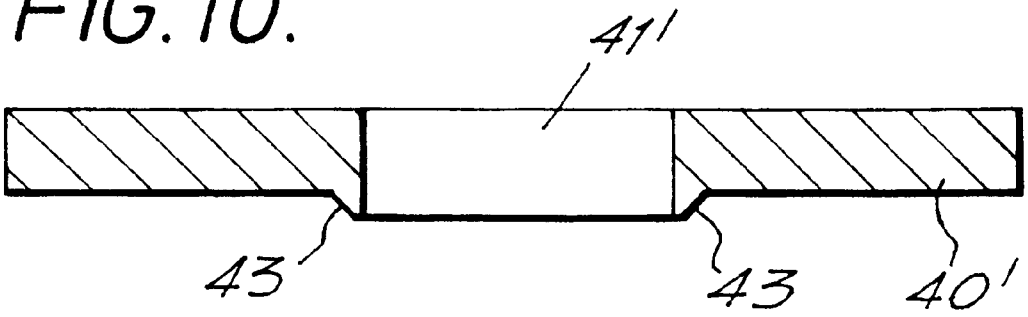

In FIGS. 8 and 9 is shown the attachment means in position at the upper end of a stopper rod 50, having a centrally-disposed, axial bore 51. Bore 51 is stepped to provide an annular recess 52 extending around the bore.

A first sleeve 10 has been moulded in-situ in recess 52 during the manufacture of the stopper rod 50. Sleeve 10 is of construction as is shown in FIGS. 1 and 2 except that it is provided with one or more apertures through its wall. A pin 15 is provided in each aperture so as to project inwardly into recess 52. Sleeve 10 has an inwardly directed pair of annular flanges, only one of which, flange 12, can be seen. Connector rod 20 of construction as shown in FIGS. 3 and 4, has been passed into bore 51 of the stopper rod until its shoulders 22, 23, of which only shoulder 23 can be seen in FIG. 8, have passed through the annular spaces between shoulders 11 and 12. Pins 15 through sleeve 10 limit the travel of rod 20 into the bore 51 by providing obstruction to its shoulders 22, 23. Connector rod 20 has then been rotated until its shoulders lie directly underneath those of sleeve 10 and then moved upwardly until the angled upper and lower faces respectively of the shoulders and flanges of the rod and sleeve are in contact. In this configuration the annular spaces 13 and 14 of sleeve 10 are empty.

Second sleeve 30, having been slid on to connector rod 20, has been pushed down into the bore 51 so that its axial projections 32 fit into annular spaces 13 and 14. Sleeve 30 is of a length such that in this position its upper end lies substantially flush with the upper end of the stopper rod 50.

Seals 60, only one of which is shown, have been positioned between the lower face 31A of sleeve 30 and the flat upper faces 11A, 12A of sleeve 10.

A sealing washer 61 is positioned on the upper face of stopper rod 50 with the connector rod 20 passing through it. Pressure disc 40 is positioned on the connector rod to lie in contact with sealing washer 61. A nut 62 is threaded on to connector rod 20 and rotated downwardly into contact with upper face 40A of pressure disc 40 to compress washer 61 beneath disc 40 so that rib 42 from the lower face 40B of disc 40 presses into washer 61. By this means, i.e. downward rotation of nut 62, the components of the attachment means are firmly locked together and it is impossible for connector rod 20 to move relative to stopper rod 50. Connector rod 20 may then be safely attached to a lifting and lowering mechanism for the stopper rod.

FIG. 8A shows the region A of FIG. 8 in greater detail, i.e. the region where the upper end of second sleeve 30 contacts the sealing washer 61 beneath pressure disc 40 and nut 62. As can be seen, the upper end of sleeve 30 extends slightly above the upper end of stopper rod body 50 and impresses an indentation accordingly into washer 61. By this means, second sleeve 30 can compensate for thermal expansion of rod 20 during use of the stopper rod and thereby ensure that a good seal is maintained.

FIG. 9 is a similar view to FIG. 8 with the assembly rotated about its longitudinal axis as explained above.

Figure 11:
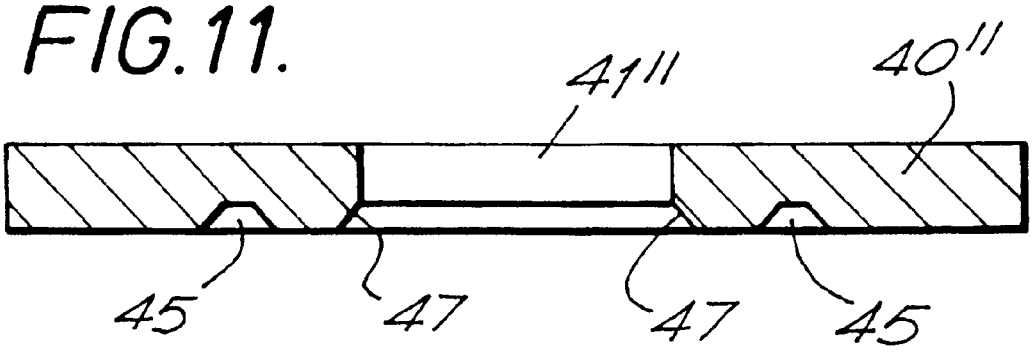
Figure 12:
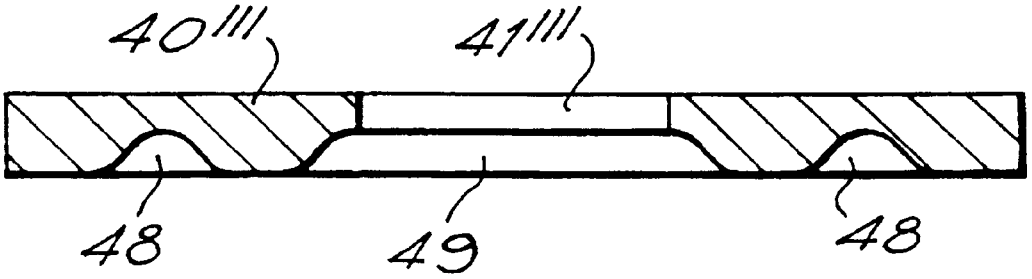

The pressure disc 40 may have a variety of different shapes depending on the locations and shapes of protrusions or indentations in order to increase the pressure sealing effect. See for example FIGS. 11, 12 and 13 in which pressure discs 40', 40" and 40'" respectively are shown.

Disc 40' has a protrusion 43 from its lower face, the protrusion being in the form of an annular rib adjacent the central hole 41' through the disc 40'.

Disc 40" has an indentation 45 in its lower surface, the indentation being in the form a flat-bottomed annular groove surrounding and spaced from central hole 41", and an angled edge portion 47 at the junction of its lower face and hole 41".

Disc 40'" is similar to disc 40" but its annular groove 48 is round-bottomed and edge portion 49 leading into central hole 41'" is also rounded.

We claim:

1. A means for attaching a stopper rod (50) in the form of an elongate moulded body having a longitudinal bore (51) to a lifting and lowering mechanism, characterised in that the means comprises a first sleeve (10) to be moulded in-situ in the stopper rod body (50) to lie coaxially with the stopper rod body (50) in an annular recess (52) surrounding and coterminous with the bore (51), the sleeve (10) having a pair of circumferentially-spaced inwardly-directed, arcuate flanges (11, 12), a connecting rod (20) of diameter to fit into the stopper rod bore (51) and of length to extend outside the stopper rod (50) while passing through the first sleeve (10) when the sleeve (10) is in position in the stopper rod (50), the connecting rod (20) having a pair of circumferentially-spaced, arcuate shoulders (22, 23) of size to pass through the spaces between the flanges (11, 12) of the first sleeve (10), whereby the connecting rod (20) may be passed through the first sleeve (10) until its shoulders (22, 23) have passed beyond the flanges (11, 12) of the first sleeve (10) and then rotated until its shoulders (22, 23) are in circumferential correspondence with the flanges (11, 12), and a second sleeve (30) of external diameter to fit in the bore (51) of the stopper rod (50) and having at one end a pair of circumferentially-spaced, arcuate, axially-extending projections (32), the projections (32) having an internal radius sufficient to accommodate the connecting rod (20) through the second sleeve (30) and the projections (32) being of a size to fit into the spaces between the flanges (11, 12) of the first sleeve (10) whereby the shoulders (22, 23) of the connecting rod (20) may be locked beyond the flanges (11, 12) of the first sleeve (10).

2. Attachment means according to claim 1 characterised in that the connecting rod (20) is externally threaded at least for a portion of its length intended to extend from the stopper rod (50).

3. Attachment means according to claim 1 characterised in that the connecting rod (20) has an axially extending bore (21).

4. Attachment means according to claim 1 characterised in that the first sleeve (10) is circular in plan view.

5. Attachment means according to claim 1 characterised in that the first sleeve (10) has flat-sided portions around its periphery.

6. Attachment means according to claim 1 characterised in that the connecting rod (20) carries an apertured pressure disc (40, 40', 40", 40'").

7. Attachment means according to claim 6 characterised in that the connecting rod (20) has a threaded nut (62).

8. Attachment means according to claim 1 characterised in that a sealing washer (60) is positioned between the upper faces of the flanges (11, 12) of the first sleeve (10) and the corresponding face (31A) of the second sleeve (30).

9. A stopper rod (50) fitted with means of attachment to a lifting and lowering mechanism characterised in that the means is an attachment means according to claim 1.

10. A stopper rod (50) according to claim 9 characterised in that the bore (51) of the stopper rod extends the entire length of the stopper rod (50).

11. A stopper rod (50) according to claim 9 characterised in that the lower end of the stopper rod bore (51) is closed.

12. A stopper rod (50) according to claim 9 characterised in that the height of the second sleeve (30) is such that the end of the sleeve (30) remote from its projections (32) lies substantially in the plane of the upper end of the stopper rod (50).

13. A stopper rod (50) according to claim 9 characterised in that the outside diameter of the second sleeve (30) is such that the sleeve (30) is a tight fit in the bore(51) at the upper end of the stopper rod (50).

14. A stopper rod (50) according to claim 9 characterised in that an apertured pressure disc (40, 40', 40", 40'") is carried on the connecting rod (20) and is maintained under pressure against the upper face of the stopper rod (50).

15. A stopper rod (50) according to claim 14 characterised in that the pressure is maintained by a nut (62) threaded on to the connecting rod (20) and rotated along the rod (20) until it bears sufficiently on the disc (40, 40', 40", 40'").

16. A stopper rod (50) according to claim 15 characterised in that a sealing washer (61) is positioned between the pressure disc (40, 40', 40", 40'") and the upper face of the stopper rod (50).

* * * * *